US010890875B2

(12) United States Patent
Wu

(10) Patent No.: US 10,890,875 B2
(45) Date of Patent: Jan. 12, 2021

(54) CONNECTING MEMBER

(71) Applicant: General Plastic Industrial Co., Ltd., Taichung (TW)

(72) Inventor: Yi-Chia Wu, Taichung (TW)

(73) Assignee: GENERAL PLASTIC INDUSTRIAL CO., LTD., Taichung (TW)

( * ) Notice: Subject to any disclaimer, the term of this patent is extended or adjusted under 35 U.S.C. 154(b) by 379 days.

(21) Appl. No.: 16/104,608

(22) Filed: Aug. 17, 2018

(65) Prior Publication Data

US 2019/0391524 A1 Dec. 26, 2019

(30) Foreign Application Priority Data

Jun. 21, 2018 (TW) ..... 107121291 A

(51) Int. Cl.
*G03G 21/16* (2006.01)

(52) U.S. Cl.
CPC ..... *G03G 21/1647* (2013.01)

(58) Field of Classification Search
CPC ..... G03G 21/1647; G03G 15/757; G03G 21/186; G03G 2221/1657; G03G 21/1857
See application file for complete search history.

(56) References Cited

U.S. PATENT DOCUMENTS

2014/0270845 A1* 9/2014 Kawakami ..... G03G 21/1647 399/110
2016/0246250 A1* 8/2016 Kamoshida ..... G03G 21/1676
2017/0108816 A1* 4/2017 Kawakami ..... G03G 15/757

* cited by examiner

*Primary Examiner* — Sandra Brase
(74) *Attorney, Agent, or Firm* — Muncy, Geissler, Olds & Lowe, P.C.

(57) ABSTRACT

A connecting member includes a tube portion, a bottom portion provided at an end of the tube portion, an opening provided at the other end of the tube portion, two resilient arms spacedly extending from the bottom portion toward the opening in a way that each of the resilient arms is distanced from an inner wall surface of the tube portion, and two pin holes disposed in the two resilient arms, respectively. The connecting member is adapted to be coupled with a rotational force receiving member in a way that the rotational force receiving member is freely swingable within an angle range relative to the connecting member without being detached from the connecting member.

10 Claims, 6 Drawing Sheets

CONNECTING MEMBER

BACKGROUND OF THE INVENTION

1. Field of the Invention

The present invention relates generally to an electronic image-forming apparatus and more particularly, to a connecting member adapted for being used in a toner cartridge of an electronic image-forming apparatus.

2. Description of the Related Art

A normal electronic image-forming apparatus, such as photocopier or printer, is generally equipped with a replaceable toner cartridge therein. Inside the toner cartridge, a plurality of roller units, such as photosensitive roller unit, developer roller unit, etc., are installed. These roller units each have a rotatable roller, which is disposed inside a housing of the toner cartridge, a connecting member connected to an end of the rotatable roller, and a rotational force receiving member coupled to the connecting member, such that the roller, the connecting member and the rotational force receiving member are rotatable synchronously. The rotational force receiving member protrudes outside the housing and is engageable with a driving head provided inside the electronic image-forming apparatus. As a result, when the driving head rotates, the roller is driven by the connecting member via the rotational force receiving member to rotate relative to the housing of the toner cartridge so as to perform a developing or photosensitive work.

To fulfill the requirements of installing the toner cartridge into the electronic image-forming apparatus and dismantling the toner cartridge from the electronic image-forming apparatus, the rotational force receiving member has to be connected to the connecting member in a freely swingable manner. Therefore, how to assemble the rotational force receiving member with the connecting member to enable that the rotational force receiving member is freely swingable in a certain range of angles without being detached from the connecting member is a technical issue to be solved by the manufacturers in this industry field.

As far as known, a commercially available solution for solving the above-mentioned issue is to make the connecting member have a two-piece structure, which is composed of a main body and a cover. After the pin of the rotational force receiving member is inserted into the main body, the cover is capped on the main body, such that the pin is restrained between the main body and the cover, resulting in that the rotational force receiving member can be connected to the connecting member in a freely swingable manner. This solution has a disadvantage in that the connecting member that is composed of a main body and a cover has a complicated structure. As such, assembly of the connecting member is time-consuming and the manufacturing cost of the connecting member cannot be reduced.

SUMMARY OF THE INVENTION

The present invention has been accomplished in view of the above-noted circumstances. It is an objective of the present invention to provide a connecting member adapted to be coupled with a rotational force receiving member in a way that the rotational force receiving member is freely swingable within a certain range of angles relative to the connecting member without being detached from the connecting member.

Another objective of the present invention is to provide a connecting member, which has a simple structure and can be rapidly made and assembled with the rotational force receiving member in a short time.

To attain the above-mentioned objectives, the present invention provides a connecting member comprising a tube portion defining a first imaginary axis, a bottom portion, an opening, two resilient arms and two pin holes. The bottom portion is provided at an end of the tube portion. The opening is provided at the other end of the tube portion. The two resilient arms spacedly extend from the bottom portion toward the opening. Each resilient arm is spaced at a predetermined distance from an inner wall surface of the tube portion. The two pin holes are disposed in the two resilient arms, respectively. The two pin holes are aligned in a second imaginary axis that is not parallel to the first imaginary axis.

With the above-mentioned features, the connecting member is capable of being coupled with a rotational force receiving member in a way that the rotational force receiving member is freely swingable within a certain range of angles relative to the connecting member without being detached from the connecting member. Further, the connecting member is configured having a simple structure and can be rapidly made and assembled with the rotational force receiving member in a short time.

BRIEF DESCRIPTION OF THE DRAWINGS

The present invention will become more fully understood from the detailed description given herein below and the accompanying drawings which are given by way of illustration only, and thus are not limitative of the present invention, and wherein.

DETAILED DESCRIPTION OF THE INVENTION

Figure 1:
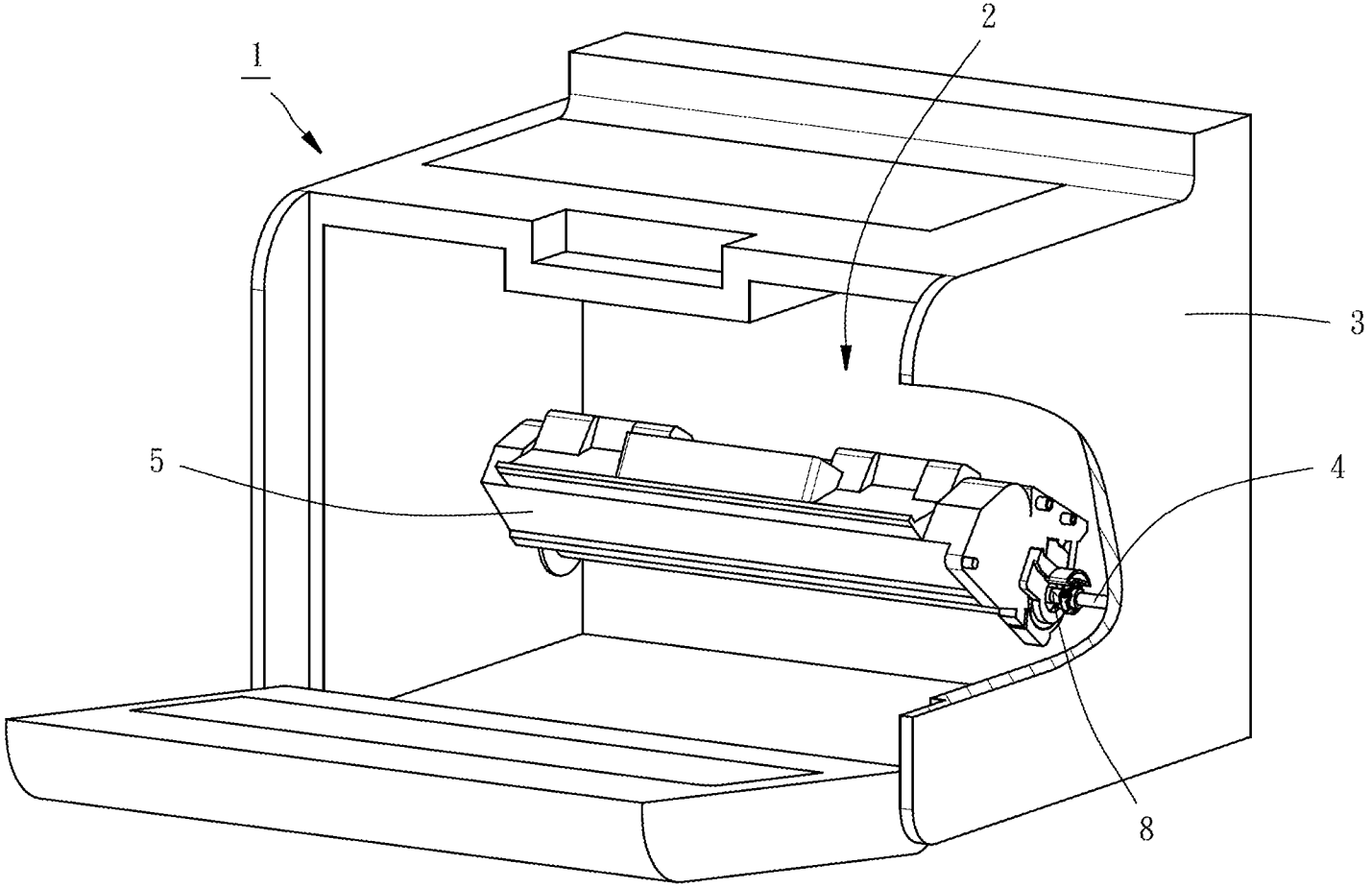
FIG. 1 is a schematically perspective view, showing an electronic image-forming apparatus comprising a toner cartridge.

Hereunder two embodiments will be described with accompanying drawings for illustrating technical features and structures of the present invention. FIG. 1 shows an electronic image-forming apparatus 1, such as photocopier or printer. The electronic image-forming apparatus 1 is provided at an inside thereof with an accommodation 2, in which a toner cartridge 5 is disposed. The electronic image-forming apparatus 1 has a lateral wall 3 disposed with a driving head 4. The driving head 4 extends into the accommodation 2 and is engageable with a rotational force receiving member 8 of a roller unit 6 (see FIG. 2) of the toner cartridge 5 for driving the roller unit 6 to rotate.

Figure 2:
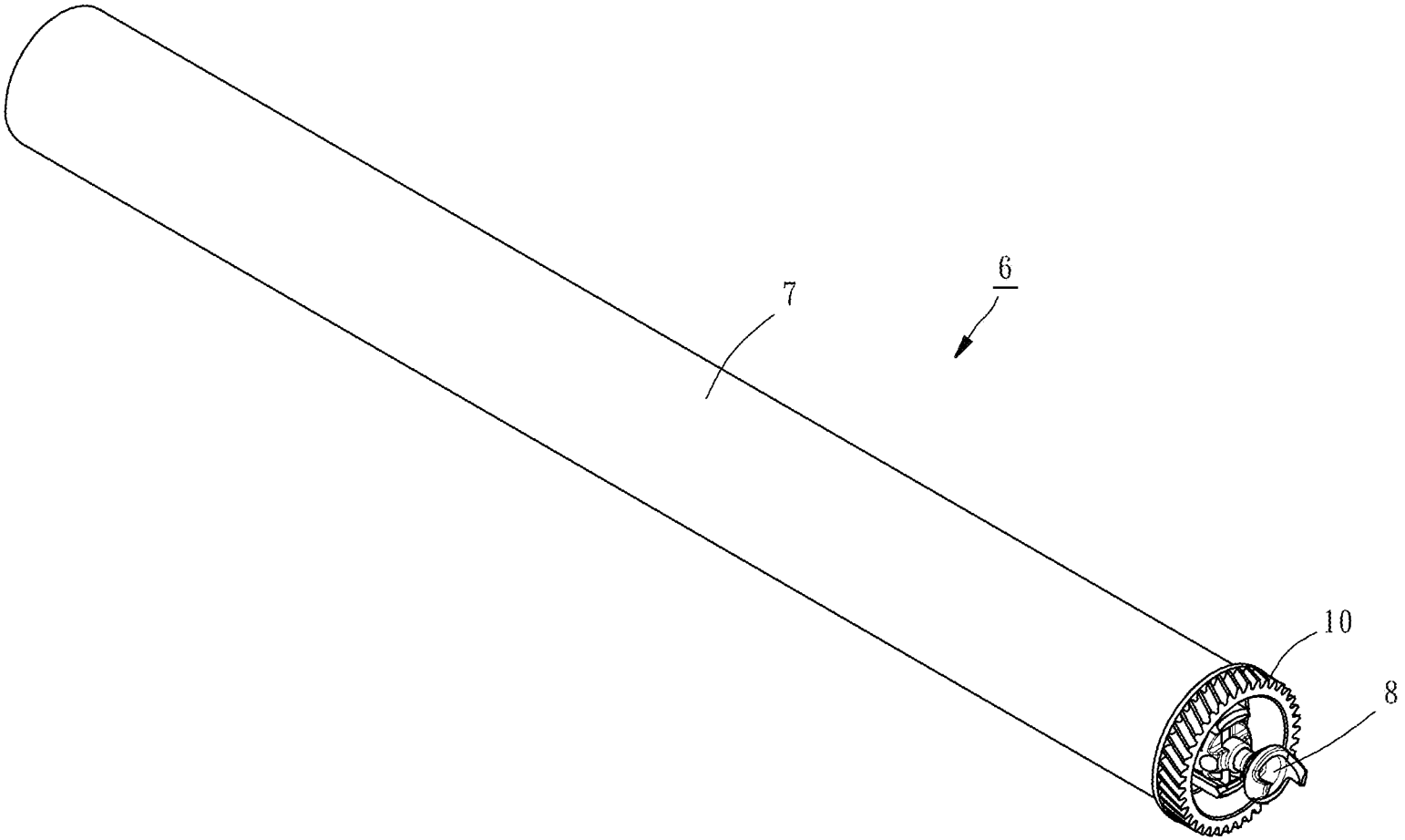
FIG. 2 is a perspective view, showing that a connecting member in accordance with a first embodiment of the present invention is used in a roller unit.

Referring to FIG. 2, the roller unit 6 is composed of a roller 7, a rotational force receiving member 8, and a connecting member 10 according to a first embodiment of the present invention. The roller 7 is an elongated circular tube, which may be realized as a photosensitive drum, a developer roller or other functional rollers. The connecting member 10 is used to connect the roller 7 and the rotational force receiving member 8 in such a way that the rotational force receiving member 8 is freely swingable within a certain range of angles relative to the connecting member 10. The rotational force receiving member 8 is used to couple the driving head 4. As a result, when the driving head 4 rotates, the roller 7 is driven by the connecting member 10 via the rotational force receiving member 8 to rotate so as to perform a photosensitive or developing work.

Figure 3:
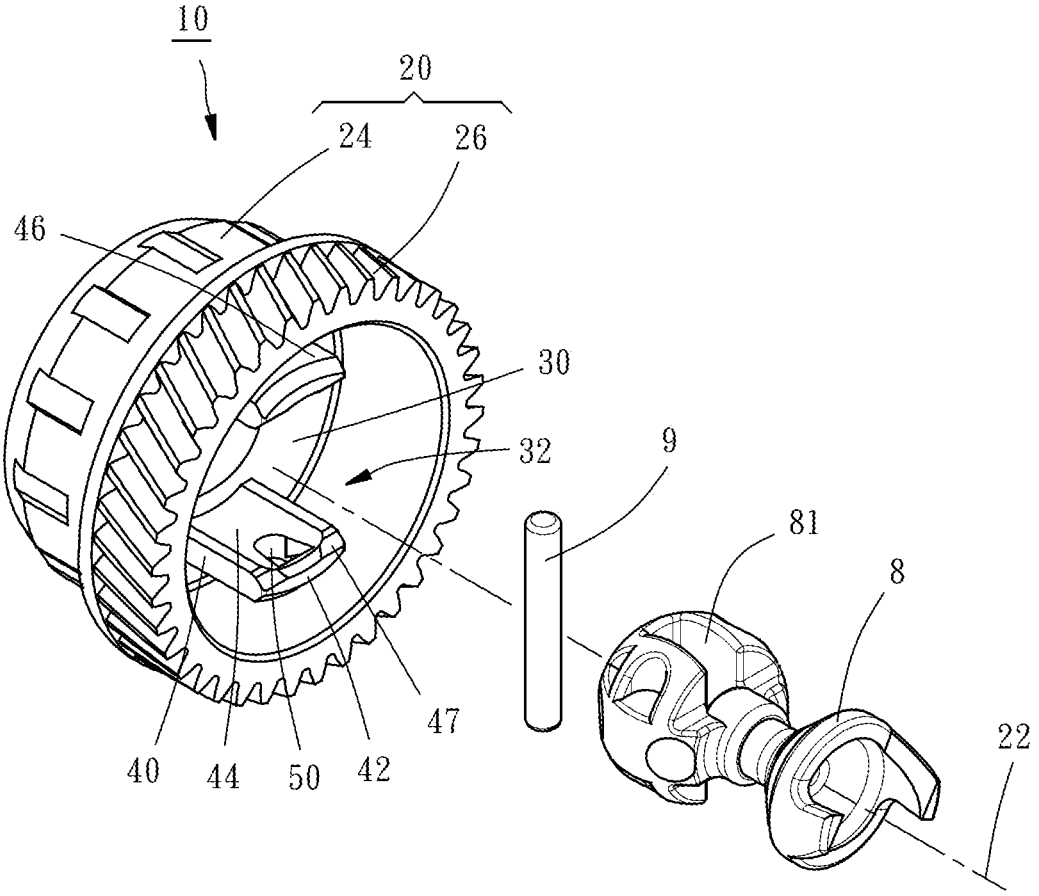
FIG. 3 is an exploded view, showing the connecting member of the first embodiment of the present invention, a pin and a rotational force receiving member.

As shown in FIG. 3, the connecting member 10 includes a tube portion 20, a bottom portion 30, an opening 32, two resilient arms 40 and two pin holes 50. The rotational force receiving member 8 is coupled to the connecting member 10 by a pin 9.

The tube portion 20 has a circular tubular shape defining a first imaginary axis 22. An outer periphery of the tube portion 20 is provided with a small-diameter inserting section 24 and a big-diameter annular tooth portion 26. The inserting portion 24 is inserted into the roller 7, such that the connecting member 10 and the roller 7 are coupled with each other and rotatable synchronously. The annular tooth portion 26 is adapted to be engaged with a gear (not shown) of the electronic image-forming apparatus 1 for conveying rotational force to other elements. However, in other embodiments, the annular tooth portion 26 of the tube portion 20 can be omitted.

Figure 4:
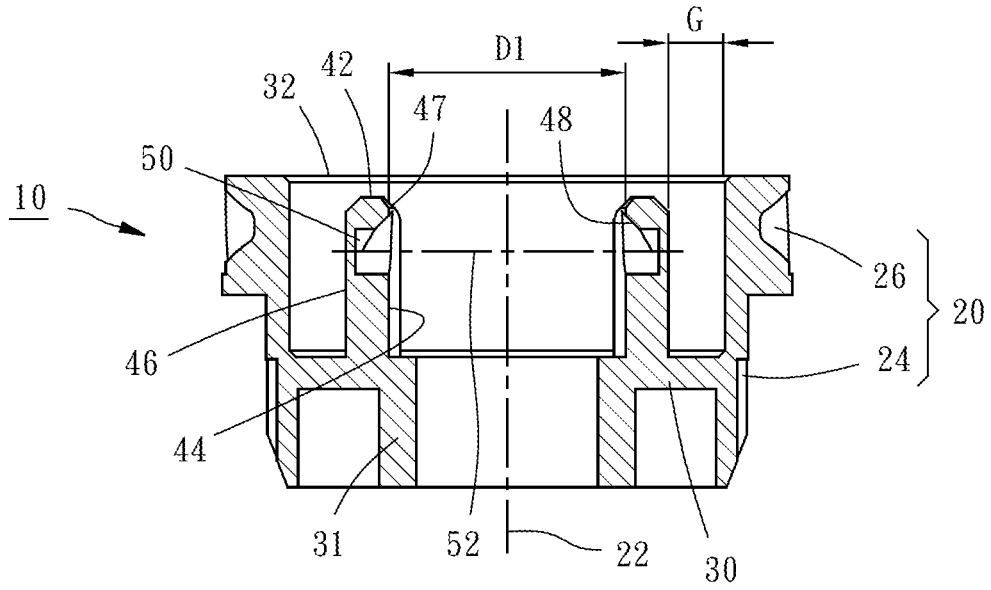
FIG. 4 is a sectional view of the connecting member of the first embodiment of the present invention.
Figure 6:
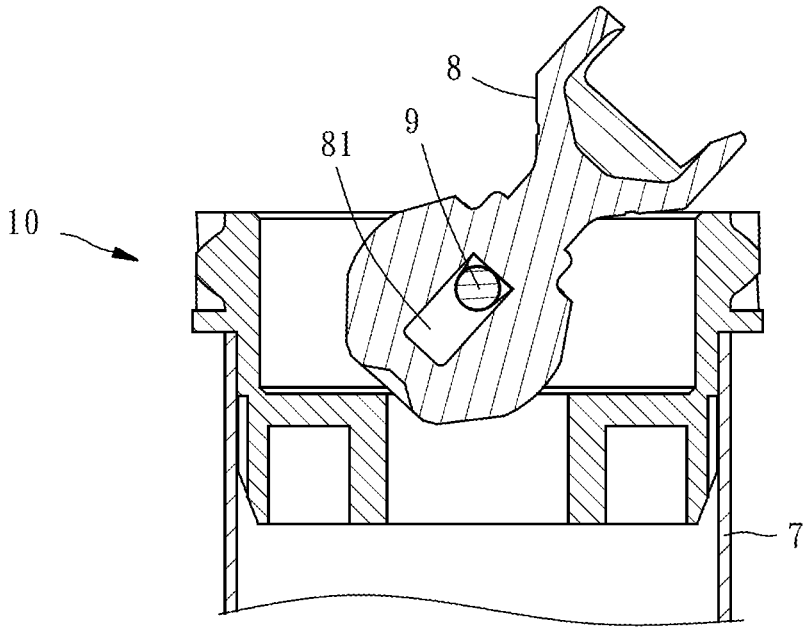
FIG. 6 is a sectional view showing the connecting member is coupled with the rotational force receiving member via the pin in a state of use.
Figure 7:
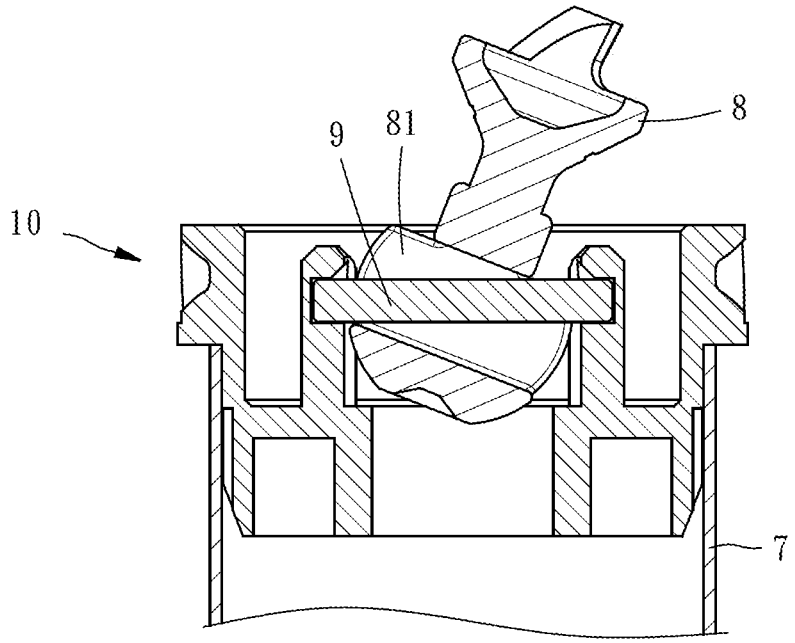
FIG. 7 is another sectional view showing the connecting member is coupled with the rotational force receiving member via the pin in a state of use.

The bottom portion 30 is provided at an end of the tube portion 20 (i.e. the bottom end as shown in FIG. 4), and the opening 32 is provided at the other end of the tube portion 20 (i.e. the top end as shown in FIG. 4). In the present invention, the term "an end" means a portion opposite to "the other end". That is, the term "an end" cannot be narrowly interpreted as a distal end or a terminal end. As shown in FIG. 4, the bottom portion 30 is not located at the distal bottom, end, but the bottom portion 30 can be broadly interpreted as being located at an end opposite to the opening 32. The bottom end 30 is provided with an inner tube 31 extending in a direction parallel to the first imaginary axis 22. As shown in FIGS. 6 and 7, the inner tube 31 can receive a bottom of the rotational force receiving member 8. However, the inner tube 31 is not an essential technical feature of the present invention. In other embodiments, the inner tube 31 may be omitted.

As shown in FIGS. 3 and 4, the two resilient arms 40 are spaced from each other at a predetermined distance and extend from the bottom portion 30 toward the opening 32 in such a way that a predetermined distance G is left between each resilient arm 40 and an inner wall surface of the tube portion 20. In this embodiment, the resilient arms 40 extend in a direction parallel to the first imaginary axis 22; however, this is not an essential technical feature of the present invention. The two pin holes 50 are disposed in the two resilient arms 40, respectively. The two pin holes 50 are aligned in a second imaginary axis 52 that is perpendicular to the first imaginary axis 22. Specifically, each resilient aim 40 has a top surface 42 facing toward the opening 32, an inner lateral surface 44 and an outer lateral surface 46 opposite to the inner lateral surface, and the inner lateral surfaces 44 of the resilient arms 40 are arranged face to face. Further, the pin hole 50 of each resilient arm 40 is recessed inwardly from the inner surface 44 of the resilient arm 40 in such a way that the pin hole 50 is not communicated with the top surface 42 of the resilient arm 40, the pin hole 50 has an enclosing pin wall extending in the second imaginary axis 22, and the pin hole 50 does not penetrate through the arm 40, i.e. the pin hole 50 has an opening on the inner lateral surface 44 and a closed end. Furthermore, the top surface 42 of each resilient arm 40 has an outer chamfer 47 adjoining the inner lateral surface 44 of the resilient arm 40, and an upper side of each of the pin holes 50, i.e. the side is close to the opening 32 than a lower side of the pin hole 50 is, has an inner chamfer 48 adjoining the inner lateral surface 44 of the resilient arm 40. However, in other embodiments of the present invention, the outer chamfers 47 and/or the inner chamfers 48 may be omitted.

Figure 5:
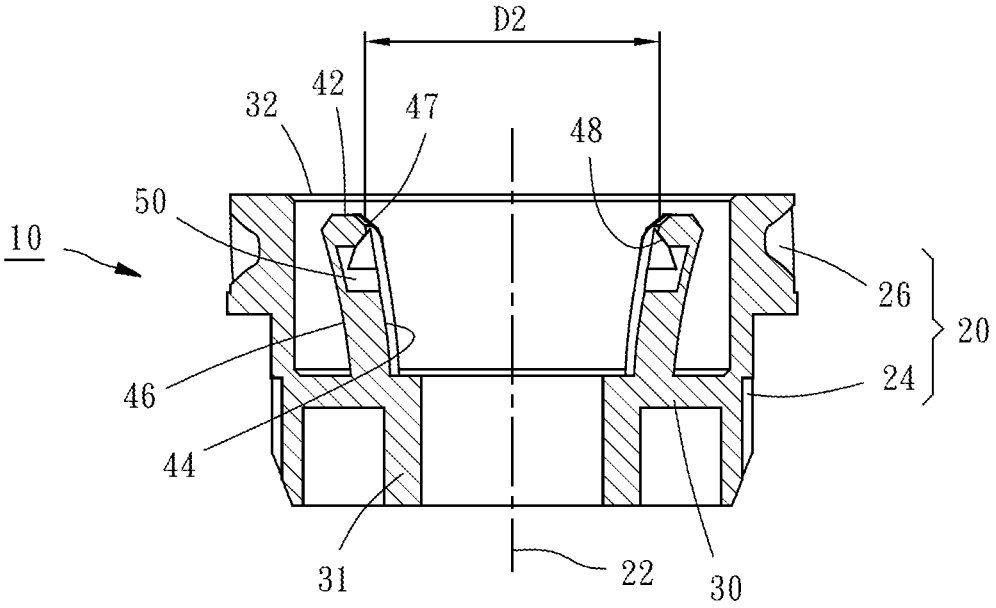
FIG. 5 is a schematically sectional view of the connecting member of the first embodiment of the present invention, showing that two resilient arms deform.

To assemble the connecting member 10 with the rotational force receiving member 8, the pin 9 is inserted through a through groove 81 of the rotational force receiving member 8 in advance, and then the two ends of the pin 9 are forcedly inserted into the two pin holes 50, respectively, by means of elastic deformation of the resilient arms 40. As shown in FIG. 4, when the two resilient arms 40 receive no external force, the two arms 40 stand upright without deformation. In this condition, the free ends (i.e., the top ends 42) of the two arms 40 are spaced from each other at an initial distance D1. Referring to FIG. 5, when the two resilient arms 40 receive an external force, the two resilient arms 40 deform, such that the free ends (i.e., the top ends 42) of the two arms 40 are spaced from each other at an increased distance D2 longer than the initial distance D1. This technical feature facilitates insertion of the two ends of the pin 9 into the two pin holes 50. Specifically, when the two ends of the pin 9 abut against the two outer chamfers 47 of the two resilient arms 40 and move downward, the movement of the two ends of the pin 9 forcedly expend the distance between the free ends of the two resilient arms 40, facilitating insertion of the two ends of the pin 9 into the two pin holes 50, respectively. When the external force is released, the two resilient arms 40 will elastically rebound to their initial postures, and in the meantime the inner chamfers 48 will guide the two ends of the pin 9 exactly into the two pin holes 50, respectively.

After the rotational force receiving member 8 is coupled to the connecting member 10 by the pin 9, the pin 9 stays stationary and the rotational force receiving member 8 however can move along the pin 9, in a direction perpendicular to the pin 9 or in other arbitrary direction because the through groove 81 has a diameter much larger than the diameter of the pin 9. As a result, the rotational force receiving member 8 can freely swing within a certain range of angles relative to the connecting member 10 and will not separate from the connecting member 10, as shown in FIGS. 6 and 7. Further, because the connecting member 10 of the present invention is integrally made as one single piece, which is different from the conventional solution that needs to couple a main body and a cover to restrain a pin, the connecting member 10 of the present invention has less elements in manufacturing and needs not to align and couple a main body with a cover in assembly, thereby greatly shortening the manufacturing and assembling times of the connecting member and the rotational force receiving member so as to achieve the objectives of the present invention.

Figure 8:
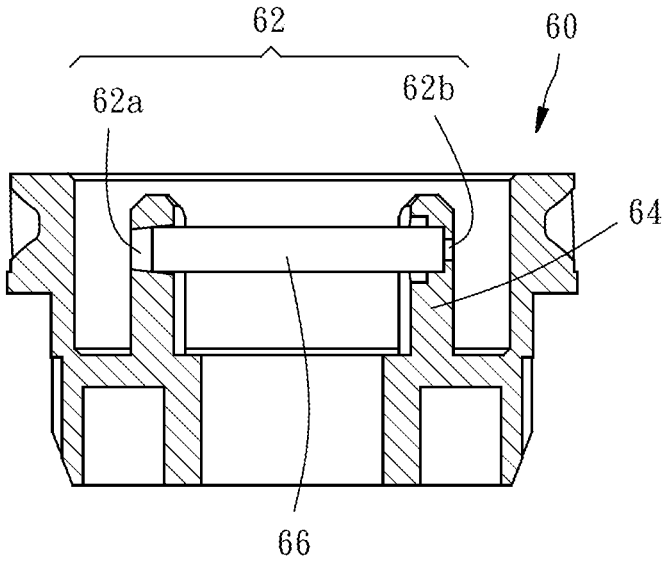
FIG. 8 is a sectional view of a connecting member in accordance with a second embodiment of the present invention.

Based on the above-mentioned technical features, various modifications to the structure of the connecting member 10 may be made. For example, FIG. 8 shows a connecting member 60 in accordance with a second embodiment of the present application. The structure of the connecting member 60 is basically the same as that of the connecting member 10 of the first embodiment, except that the two pin holes 62 penetrate through the two resilient arms 64, respectively. Further, the left pin hole 62*a* has a funnel-shaped inner section, and the right pin hole 62*b* has a stepwise-shaped inner section. Since the outer sections of the two pin holes 62 have a diameter smaller than the diameter of the pin 66, the pin 66 can be inserted into and retained in the two pin holes 62 so as to achieve the objectives of the present invention.

In the first embodiment, the second imaginary axis is configured as being perpendicular to the first imaginary axis. However, in other embodiments of the present invention, the second imaginary axis is not required to be perpendicular to the first imaginary axis. Depending on the profile of the through groove 81 of the rotational force receiving member 8, the second imaginary axis may extend in other direction. In practice, the connecting member of the present invention may work as long as the second imaginary axis is not parallel to the first imaginary axis.

What is claimed is:

1. A connecting member comprising:

a tube portion defining a first imaginary axis;

a bottom portion provided at an end of the tube portion;

an opening provided at the other end of the tube portion;

two resilient arms spacedly extending from the bottom portion toward the opening, each of the resilient arms being spaced at a predetermined distance from an inner wall surface of the tube portion; and two pin holes disposed in the two resilient arms, respectively, and aligned in a second imaginary axis that is not parallel to the first imaginary axis.

2. The connecting member as claimed in claim 1, wherein each of the resilient arms comprises a top surface facing toward the opening, an inner lateral surface and an outer lateral surface opposite to the inner lateral surface; the pin hole of each of the resilient arms is recessed inwardly from the inner surface of the each of the resilient arms and is not communicated with the top surface of the each of the resilient arms, such that each of the pin holes has an enclosing pin wall extending in the second imaginary axis.

3. The connecting member as claimed in claim 2, wherein the top surface of each of the two resilient arms has an outer chamfer adjoining the inner lateral surface of the each of the two resilient arms.

4. The connecting member as claimed in claim 1, wherein the second imaginary axis is perpendicular to the first imaginary axis.

5. The connecting member as claimed in claim 1, wherein the two pin holes are respectively disposed in the two resilient arms in a way that the two pin holes do not penetrate through the two resilient arms.

6. The connecting member as claimed in claim 1, wherein the two pin holes are respectively disposed in the two resilient arms in a way that the two pin holes penetrate through the two resilient arms, respectively; at least one of the pin holes has an inner section with a funnel shape or a stepwise shape.

7. The connecting member as claimed in claim 1, wherein each of the two resilient arms has a free end; the two resilient arms are elastically deformable to increase a distance between the two free ends of the two resilient arms.

8. The connecting member as claimed in claim 1, wherein each of the two pin holes has an upper side and a lower side, and the upper side is close to the opening than the lower side is; the upper side of each of the two pin holes is provided with an inner chamfer.

9. The connecting member as claimed in claim 1, wherein the tube portion has an outer periphery having an annular tooth section.

10. The connecting member as claimed in claim 1, wherein the bottom portion is provided with an inner tube extending in a direction parallel to the first imaginary axis.

* * * * *